US005529469A

United States Patent [19]

Bushnell et al.

[11] Patent Number: 5,529,469

[45] Date of Patent: Jun. 25, 1996

[54] VANE HOLE COVER FOR ROTARY COMPRESSOR

[75] Inventors: Paul J. Bushnell, Syracuse; Raymond J. Swidowski, Pennellville, both of N.Y.

[73] Assignee: Carrier Corporation, Syracuse, N.Y.

[21] Appl. No.: 527,394

[22] Filed: Sep. 13, 1995

[51] Int. Cl.[6] ..... F04C 29/02

[52] U.S. Cl. ..... 418/88; 418/96; 418/248

[58] Field of Search ..... 418/15, 63, 88, 418/96, 248

[56] References Cited

U.S. PATENT DOCUMENTS 4,561,829 12/1985 Iwata et al. ..... 418/63

5,104,297 4/1992 Sekiguchi et al. ..... 418/63

5,246,356 9/1993 Scarfone ..... 418/63

*Primary Examiner*—Charles Freay

[57] ABSTRACT

Reciprocation of the vane of a rolling piston compressor can produce a pumping action which draws oil from the sump and discharges it into the gas exiting from the discharge chamber. By providing a restricted communication between the sump and the spring cavity, the amount of oil being pumped can be reduced to a level just sufficient for lubricating the vane.

3 Claims, 2 Drawing Sheets

VANE HOLE COVER FOR ROTARY COMPRESSOR

BACKGROUND OF THE INVENTION

In a high side hermetic rolling piston or fixed vane compressor the interior of the shell and the oil sump are at discharge pressure. The piston, cylinder or crankcase and vane are located between the pump end bearing and the motor end bearing with the pump end bearing, typically, being in contact with the oil sump. The vane reciprocates in a slot in the cylinder as it tracks the eccentric piston. While one end of the vane extends through the slot in the cylinder into the cavity and reciprocates in the slot as it tracks the piston, the other end is reciprocating in a spring chamber containing a spring which provides the biasing force keeping the vane in contact with the piston. At high speed, 5400–7200 rpm, the vane motion in the spring chamber behaves as a positive displacement oil pump. Independent of whether or not the vane is required as an oil pump, fluid communication with the spring chamber must be provided. A trapped volume subjected to an increase in the volume of the chamber will reduce the pressure in the chamber thereby opposing the spring which tends to bias the vane into increasing the volume. If a trapped volume contains oil or other incompressible fluids it will tend to act as a dashpot and will act with the spring to oppose movement of the vane into the spring chamber. A spring chamber extending through the crankcase has been used to avoid these problems.

A problem was noted in variable speed rotary compressors at a shaft speed of 90–120 Hz or 5400–7200 rpm. The problem was due to lubrication failure. The use of a sight glass determined that oil was being pumped out of the sump resulting in an inadequate amount of lubrication being available. The reduced amount of lubricant made bearings more prone to failure from refrigerant slugs as the refrigerant can more readily wash out the oil.

SUMMARY OF THE INVENTION

The mechanism for pumping out the oil from the sump at high speed operation is the reciprocating vane. On the discharge stroke of the compressor as well as relative to the spring cavity, the vane is being driven by the piston against the spring bias and any resistance of the fluid being compressed in the spring chamber. On the suction stroke of the compressor as well as relative to the spring cavity, the vane movement is due to the spring bias force plus the pressure force in the spring chamber on the vane. The spring chamber is exposed to discharge pressure at both ends but the rapid cycling appears to produce cavitation resulting in a two-phase mixture which is most readily discharged into the interior of the shell rather than into the oil which is effectively sealing the entrance to the spring chamber. When the two-phase mixture is discharged into the interior of the shell it encounters the compressed refrigerant being discharged from the cylinder via the muffler and is entrained thereby and carried from the compressor into the system. In addition to the problems due to the loss of oil from the compressor, there is a degradation of the heat transfer process in the system due to the presence of excess oil. The present invention restricts fluid communication between the spring chamber and the oil sump while free communication is maintained with the interior of the shell. As a result, oil is available to be drawn into the spring chamber in an amount sufficient to provide lubrication to the vane while avoiding pumping out the oil from the compressor.

It is an object of this invention to prevent pumping out of the oil in a rotary compressor.

It is an object of this invention to have safer flooding at all operating speeds.

It is a further object to reduce sound and power draw due to pumping oil via the vane. These objects, and others as will become apparent hereinafter, are accomplished by the present invention.

Basically, restricted communication is provided between the oil sump and the spring chamber whereby the pumping action of the vane primarily acts on the high pressure refrigerant in the shell. Sufficient communication is present to permit lubricating the vane.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENT

Figure 1:
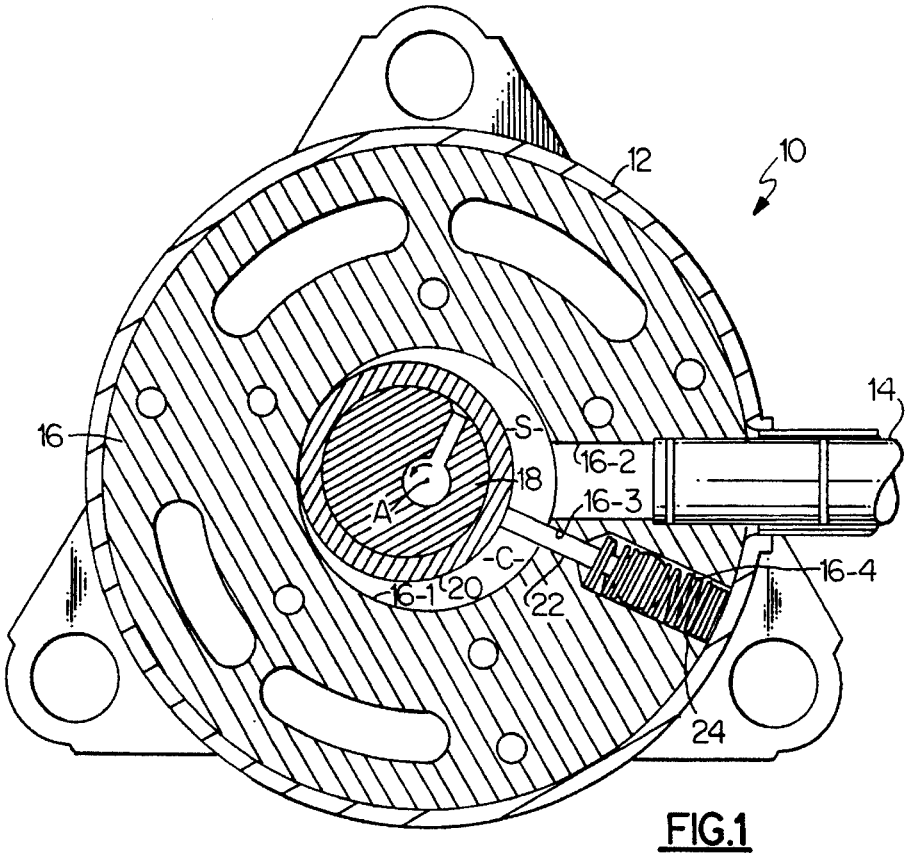
FIG. 1 is a sectional view through the crankcase of a vertical rolling piston compressor.

In FIG. 1, the numeral 10 generally designates a fixed vane or rolling piston compressor having a shell or casing 12 and a suction line 14. Crankcase 16 is secured in shell 12 and has axially extending cylindrical piston bore 16-1 formed therein. Radial bore 16-2 is formed in crankcase 16 and provides fluid communication between suction line 14 and piston bore 16-1. Piston 20 is located on the eccentric of the eccentric shaft 18 and rolls along the wall of cylindrical piston bore 16-1 and coacts therewith to define a crescent shaped chamber which, as illustrated, is divided by vane 22 into suction chamber, S, and compression chamber, C.

Axis A—A which appears in FIG. 1 as point A is the centerline for shell 12 and for bore 16-1 as well as the axis of rotation for eccentric shaft 18. Spring 24 is located in spring chamber 16-4 and biases vane 22 into contact with piston 20. In operation, vane 22 reciprocates as it remains in contact with piston 20 while piston 20 rolls around the wall of bore 16-1. The line of contact between piston 20 and the wall of bore 16-1 will reach vane 22, whose slot 16-3 opens into bore 16-1 and spring chamber 16-4, at the completion of the discharge stroke. The hot, compressed gas discharged, in a pulsed flow, from compression chamber C serially passes through a discharge port, muffler, interior of shell 12 and out a discharge line (not illustrated), as is conventional for a high side rotary compressor. The reciprocation of vane 22 as it tracks piston 20 can have a pumping effect with respect to the fluid in spring chamber 16-4 under certain conditions. Specifically, check valves, or their equivalent, at lower speeds or cavitation at higher speeds will produce a pumping action. Oil level reduction and the attendant lack of lubrication is the specific problem addressed by the present invention. When vane 22 is reciprocating at 90–120 Hz the suction strokes are on the order of 0.004 to 0.006 seconds, as are the discharge strokes. This rapid reduction of pressure produces a two-phase flow which is discharged into the shell because of the resistance of the oil sump relative to the flow of two-phase flow into the sump. The two-phase flow in the shell is readily entrained by the discharge gas and carried from the compressor 10 into the system thereby creating the potential for lubrication problems in compressor 10.

Figure 2:
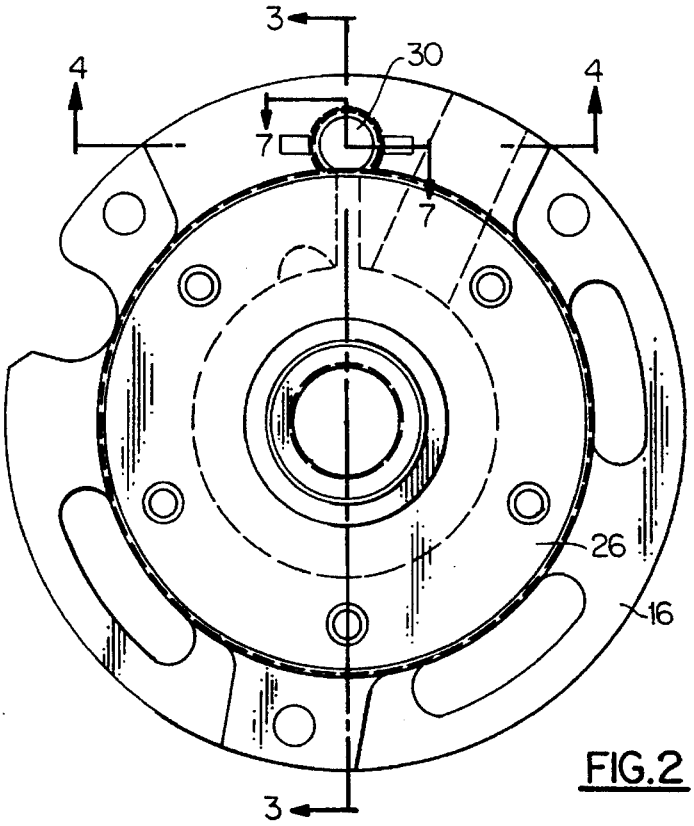
FIG. 2 is a bottom view of the crankcase and pump end bearing of FIG. 1.
Figure 3:
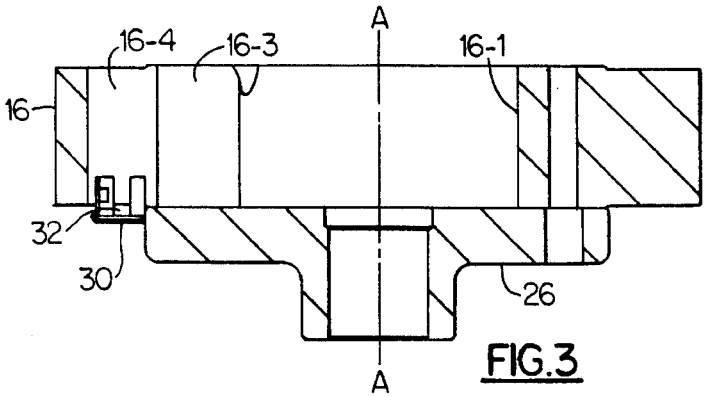
FIG. 3 is a sectional view taken along line 3—3 of FIG. 2.
Figure 4:
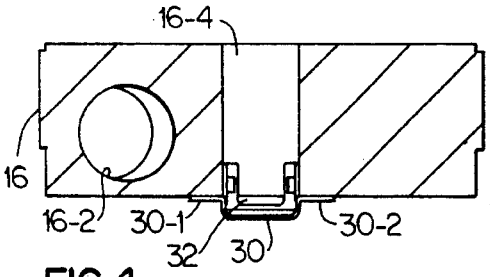
FIG. 4 is a sectional view taken along line 4—4 of FIG. 2.
Figure 5:
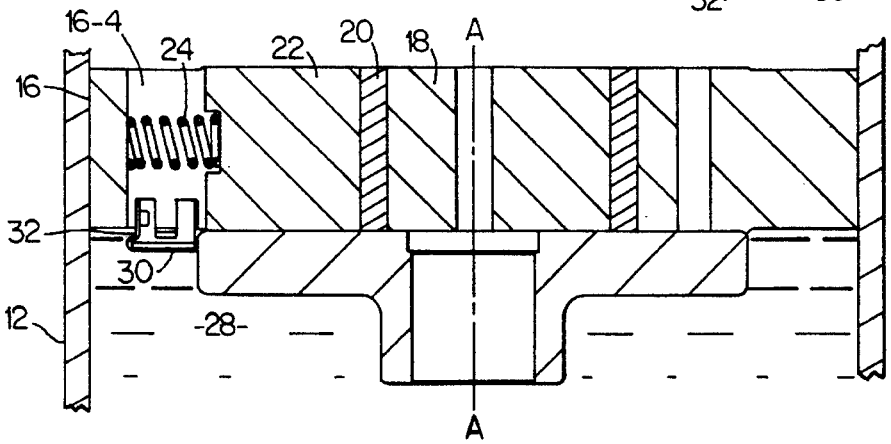
FIG. 5 corresponds to FIG. 3 but with added structure.

FIG. 2 is a bottom view of the internal structure of FIG. 1 and represents the structure that is exposed to the oil sump and includes pump end beating 26 which is suitably secured to crankcase or cylinder 16. Vane hole cover 30 is located in spring chamber 16-4 from the pump bearing side of cylinder 16. FIGS. 3 and 4 show the coaction between vane hole cover 30 and cylinder 16 which produces a nominal 0.014 inch slot 32 which defines the fluid communication opening between the oil sump and the spring chamber 16-4. FIG. 5 is similar to FIG. 3 but adds parts shown in FIG. 1 as well as the oil sump 28. Similarly, FIG. 6 corresponds to FIG. 4 but adds the vane 22 and spring 24.

Figure 6:
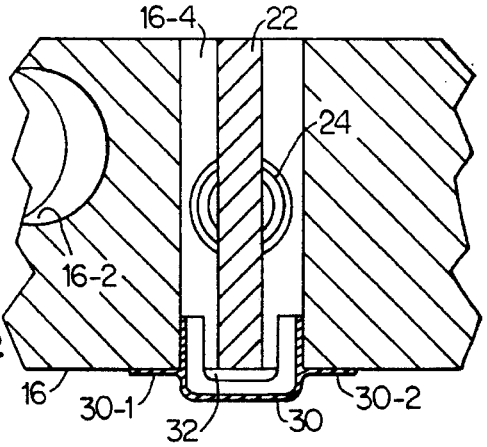
FIG. 6 corresponds to FIG. 4 but with added structure.
Figure 7:
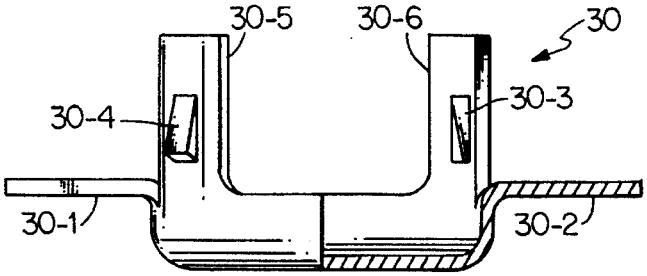
FIG. 7 is a partial sectional view of the vane cover taken along line 7—7 in FIG. 2.

FIG. 7 shows the vane hole cover 30 as shown in FIGS. 4 and 6 but with the left hand side, as viewed in FIG. 7, unsectioned. Vane hole cover 30 is preferably made of spring steel and is of a generally cylindrical configuration with one closed end. Two arms 30-1 and 30-2 are formed from the cylindrical portion and bent outwardly 90° whereby they coact with the cylinder 16 to determine the depth of entry of vane hole cover 30 into spring chamber 16-4 and thereby the width of slot 32. A plurality of circumferentially spaced punched tabs, of which 30-3 and 30-4 are illustrated, serve to hold cover 30 in place. To permit reciprocation of vane 22 in the spring chamber 16-4, slots 30-5 and 30-6 are formed in cover 30.

The presence of cover 30 modifies the previously described operation by placing a restriction, slot 32, between the oil sump 28 and spring chamber 16-4. As a result, movement of vane 22 in spring chamber 16-4 so as to define a suction stroke most readily draws high pressure gaseous refrigerant from the shell into spring chamber 16-4. Some oil does flow into chamber 16-4 such that vane 22 is kept lubricated but the pumping of oil by vane 22 is drastically reduced.

Although a preferred embodiment of the present invention has been described and illustrated, other changes will occur to those skilled in the art. It is therefore intended that the scope of the present invention is to be limited only by the scope of the appended claims.

What is claimed is:

1. A high side, vertical, hermetic compressor means including a shell comprising:

a crankcase located in said shell and separating said shell into an oil sump and a discharge chamber;

a spring chamber in said crankcase extending between said oil sump and said discharge chamber;

a piston bore in said crankcase;

a piston in said piston bore;

eccentric means driving said piston;

a vane slot in said crankcase extending between said spring chamber and said piston bore;

a vane in said vane slot;

spring means located in said spring chamber and biasing said vane into tracking contact with said piston whereby said vane reciprocates in said spring chamber in a pumping action; and fluid restriction means restricting flow between said oil sump and said spring chamber whereby said pumping action acts primarily with respect to said discharge chamber.

2. The compressor means of claim 1 wherein said fluid restriction means is a vane hole cover inserted in said spring chamber from said oil sump which coacts with said crankcase to define a slot which defines said restriction means.

3. The compressor means of claim 2 wherein said cover permits free movement of said spring means and said vane in said spring chamber.

* * * * *